US007813678B2

(12) United States Patent
Wayman

(10) Patent No.: US 7,813,678 B2
(45) Date of Patent: Oct. 12, 2010

(54) TONER IMAGE REPRODUCTION MACHINE INCLUDING A BALL VALVE DEVICE HAVING A PRESSURE RELEASE ASSEMBLY

(75) Inventor: William H Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 503 days.

(21) Appl. No.: 11/960,330

(22) Filed: Dec. 19, 2007

(65) Prior Publication Data

US 2009/0162103 A1 Jun. 25, 2009

(51) Int. Cl.
*G03G 15/08* (2006.01)

(52) U.S. Cl. ..... 399/260; 399/120; 399/262; 137/449; 251/315.01

(58) Field of Classification Search ..... 399/199, 399/120, 252–254, 258–260, 262; 137/15.22, 137/247.21, 449, 493, 493.8, 493.7, 519.5, 137/614; 141/2, 18; 251/129.14, 315.01, 251/315.16

See application file for complete search history.

(56) References Cited

U.S. PATENT DOCUMENTS 4,236,691 A 12/1980 Wright
5,070,909 A * 12/1991 Davenport ..... 137/625.32
5,586,579 A 12/1996 Diehl

OTHER PUBLICATIONS

Wayman et al., U.S. Appl. No. 11/960,295, entitled "Teeter-Totter Valve for Carrier Replenishment System", filed simultaneously herewith.
William H. Wayman, U.S. Appl. No. 11/960,258, entitled "Carrier Replenishment and Image Mottle Reduction System", filed simultaneously herewith.

* cited by examiner

*Primary Examiner*—David P Porta
*Assistant Examiner*—Benjamin Schmitt
(74) *Attorney, Agent, or Firm*—Oliff & Berridge, PLC

(57) ABSTRACT

A ball valve device for filling pressurized hoppers includes (a) a valve housing having a wall defining a chamber, a first port and a second port; (b) a valve ball rotatable within the chamber and including a through-bore for material flow from a refill container through the second port into the hopper, the valve ball having a horizontal, first hopper sealing position for pressure sealing the second port, and a vertical, second hopper opening position for opening the second port to the through-bore; and (c) a pressure release assembly including (i) a pressure release port formed through the valve housing wall and spaced from the first port and the second port; and (ii) a pressure release and particle catch assembly connected externally to the pressure release port for receiving pressure and remnant carrier particles from the refill container, thereby allowing safe release of pressure from the through-bore and from the refill container following refilling of the pressurized hopper.

20 Claims, 4 Drawing Sheets

TONER IMAGE REPRODUCTION MACHINE INCLUDING A BALL VALVE DEVICE HAVING A PRESSURE RELEASE ASSEMBLY

RELATED APPLICATIONS

This application is related to U.S. application Ser. No. 11/960,295 entitled "TEETER-TOTTER VALVE FOR CARRIER REPLENISHMENT SYSTEM" and U.S. application Ser. No. 11/960,258 entitled "CARRIER REPLENISHMENT AND IMAGE MOTTLE REDUCTION SYSTEM" both filed on the same date herewith, and having at least one common inventor.

BACKGROUND OF THE DISCLOSURE

The present disclosure relates generally to toner image reproduction machines, and more particularly, concerns such a machine including a ball valve device having a pressure release assembly.

In a typical toner image reproduction machine, for example an electrostatographic printing process machine contained within a single enclosing frame, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed at a development station by bringing a developer material in a developer housing into contact therewith. Generally, the developer material comprises magnetic carrier particles and toner particles that adhere triboelectrically to carrier particles. During development, the toner particles are attracted from the carrier particles to the latent image thereby forming a toner powder image on the photoconductive member. The toner powder image is then transferred from the photoconductive member to a copy sheet. The toner particles are then heated by a fusing apparatus within the single enclosed frame to permanently affix the powder image to the copy sheet.

Toner particles in the developer material in the developer housing accordingly become more and more depleted during image development as described above, ordinarily resulting in diminishing image quality. To maintain image quality, fresh toner particles therefore must be regularly added to the development. It has also been found that image quality can further be improved by regularly also adding fresh carrier particles to the developer housing, for example, using a carrier replenishment system.

Such a carrier replenishment system may include use of pressurized storage hopper that requires refilling under pressure. In general as with other applications, refilling a pressurized hopper under pressure from a fresh material container such as a bottle would be a problem because during the refilling the container or bottle will itself ordinarily become pressurized and hence under the same pressure as the hopper. As such, removing the container or bottle when refilling is complete (even after sealing the hopper) would be a problem because the pressurized air within the container (after it is empty) will tend to blow remnant material from the container all around causing a mess and a safety hazard.

There is therefore a need for a valve device that can enable refilling of a pressurized hopper from a container "while running" without compromising the pressure within the hopper and without the ordinary messy and hazardous results from residual pressure within the container.

SUMMARY OF THE DISCLOSURE

Thus in accordance with the present disclosure, there has been provided ball valve device for filling pressurized hoppers includes (a) a valve housing having a wall defining a chamber, a first port and a second port; (b) a valve ball rotatable within the chamber and including a through-bore for material flow from a refill container through the second port into the hopper, the valve ball having a horizontal, first hopper sealing position for pressure sealing the second port, and a vertical, second hopper opening position for opening the second port to the through-bore; and (c) a pressure release assembly including (i) a pressure release port formed through the valve housing wall and spaced from the first port and the second port; and (ii) a pressure release and particle catch assembly connected externally to the pressure release port for receiving pressure and remnant carrier particles from the refill container, thereby allowing safe release of pressure from the through-bore and from the refill container following refilling of the pressurized hopper.

BRIEF DESCRIPTION OF DRAWINGS

The foregoing and other features of the instant disclosure will be apparent and easily understood from a further reading of the specification, claims and by reference to the accompanying drawing in that:

DETAILED DESCRIPTION

Figure 1:
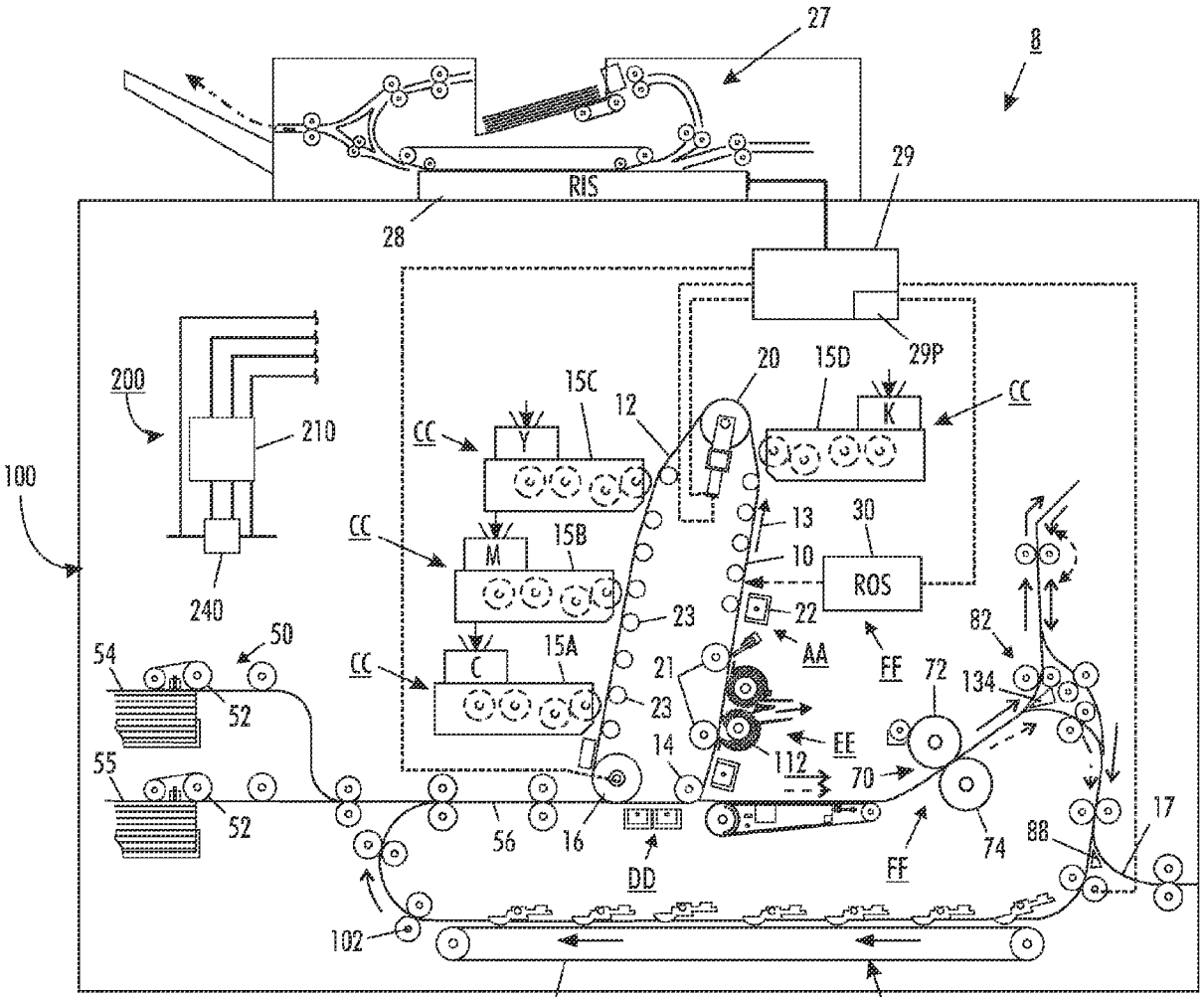
FIG. 1 is a schematic elevational view of an electrostatographic reproduction machine suitable for including the ball valve device in accordance with the present disclosure.

Referring first to the FIG. 1, it schematically illustrates an electrostatographic reproduction machine 8 that employs a photoconductive belt 10 mounted on a belt support module within a machine frame 11. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop about stripping roll 14, drive roll 16, idler roll 21, and backer rolls 23.

Initially, a portion of the photoconductive belt surface passes through charging station AA. At charging station AA, a charging wire of a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine component status information to be used for controlling operation of each such machine component.

Still referring to the FIG. 1, at an exposure station BB, the controller or electronic subsystem (ESS), 29, receives image signals from a raster input scanner (RIS) 28, representing a desired output image, and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve equally as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer housings 15A, 15B, 15C, 15D as shown, containing developer material, for example two-component developer material consisting of charged magnetic carrier particles and triboelectrically charged CMYK color toner particles, one color per developer housing. At each developer housing 15A, 15B, 15C, 15D the charged toner particles contained in the developer material that is in-use are appropriately attracted electrostatically to, and develop the latent image.

As pointed out above, in-use developer material (that is, the mix of carrier and toner particles) in each developer housing typically becomes depleted of toner particles over time as toner particles are attracted to, and develop more and more images. This is one cause of poor image quality. Fresh toner particles hence have to be frequently and controllably added to the developer housing. Another cause of poor image quality has been found to be aging carrier (to be addressed below in accordance to the carrier replenishment method and apparatus of the present disclosure).

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top copy sheet 48 and advances it to sheet transport 56. Sheet transport 56 directs the advancing sheet 48 into image transfer station DD to receive a toner image from photoreceptor belt 10 in a timed manner. Transfer station DD typically includes a corona-generating device 58 that sprays ions onto the backside of copy sheet 48. This assists in attracting the toner powder image from photoconductive surface 12 to sheet 48. After transfer, sheet 48 continues to move in the direction of arrow 60 where it is picked up by a pre-fuser transport assembly 101 and forwarded by means of a vacuum transport 110 to a fusing station FF that includes a fuser assembly 70.

The fuser assembly 70 for example, includes a heated fuser roller 72 and a pressure roller 74 with the powder image on the copy sheet contacting fuser roller 72. The pressure roller is crammed against the fuser roller to provide the necessary pressure to fix the toner powder image to the copy sheet. The fuser roller 72 is internally heated by a quartz lamp (not shown).

The sheet 48 then passes through fuser assembly 70 where the image is permanently fixed or fused to the sheet. After passing through fuser 70, a gate 88 either allows the sheet to move directly via output 17 to a finisher or stacker, or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom by a cleaning apparatus 112 at cleaning station EE.

Still referring to FIG. 1, after passing through the fusing apparatus 70, a gate 88 either allows the sheet to move directly via output 17 to a finisher or stacker (not shown), or deflects the sheet into the duplex path 101. Specifically, the sheet (when being directed into the duplex path 101), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 101, where that sheet will be inverted and then fed for recirculation back through the toner image forming module for receiving an unfused toner image on side two thereof.

Figure 2:
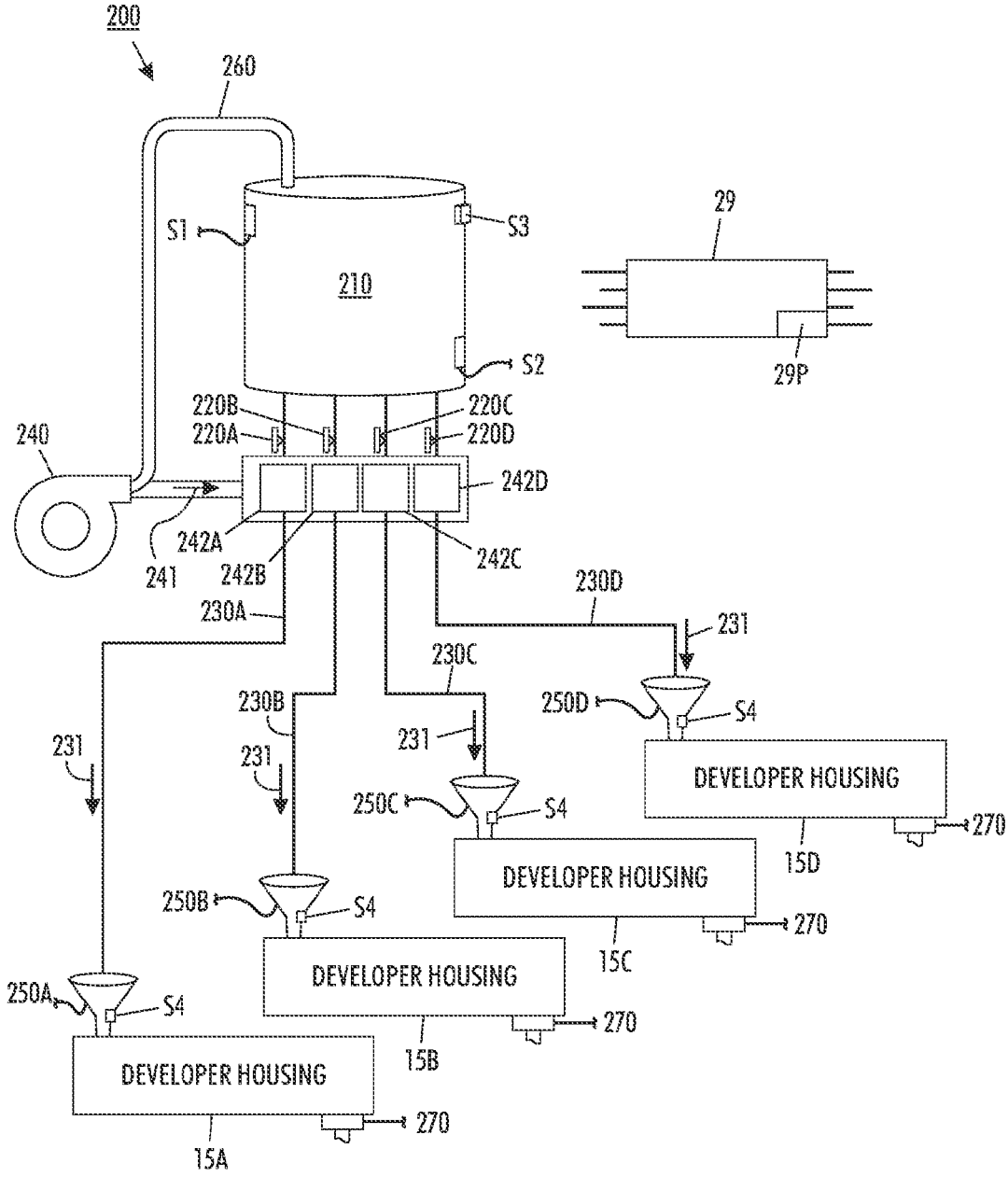
FIG. 2 is an enlarged schematic of the carrier replenishment system including the ball valve device in accordance with the present disclosure.

Referring now to FIGS. 1-2, a carrier replenishment system 200 of the present disclosure is illustrated in which desired quantities of fresh carrier are metered from a pressurized storage hopper 210 through metering valves 220A, 220B, 220C, 220D through pneumatic plenums 242A, 242B, 242C, 242D into small diameter transport tubes 230A, 230B, 230C, 230D as shown. An air blower 240 is connected to the system to supply pressurized air to the transport tubes and to pressurize the storage hopper through tube 260. The airflow or air stream 231 in the small diameter tubes is used to transport the metered carrier from the storage hopper through separator assemblies 250*a*, 250B, 250C, 250D to the individual developer housings 15A, 15B, 15C, 15D. Each developer housing includes a "trickle" port 270 for allowing overflow of in-use developer material. In this way the developer housing sump level remains constant even though fresh carrier is being added.

In accordance with the system 200, the pressurized storage hopper 210 includes level sensors S1 and S2, as well a pressure monitoring sensor S3 connected to controller 29 and a system program 29P. The storage hopper 210 as such needs to be maintained at the same air pressure as the valves and transport tubes in order to eliminate any pressure drop across the metering valves. This is because the metering valves work by gravity and so are sensitive to any differential air pressure across them. Additionally, the hopper cannot be vented at any time to atmospheric pressure because that will create a pressure difference across the metering valves and thus block the gravitational flow of carrier through the valves.

Referring to FIGS. 1-4 it can be seen that the electrostatographic image reproduction machine 8 includes (a) a moveable imaging member 10 including an imaging surface 12; (b) imaging means 22, 30 for forming a latent image on the imaging surface; and (c) a toner development station CC that includes (i) developer housings 15A, 15B, 15C, 15D each containing in-use two-component developer material including toner particles and charged magnetic carrier particles for developing images; (ii) a pressurized hopper 210 containing charged magnetic carrier particles for adding to the developer housings; and (iii) a ball valve device 300 for filling the pressurized hopper without an unsafe blow-back condition.

The ball valve device 300 provides an "air lock" type interface. In operation, a supply bottle or container 319 would be attached to the through-bore 322 with the valve ball in the horizontal orientation FIG. 3, and with an airtight seal provided for example by a taper fit between the inside of the through-bore 322 and attached bottle or container 319. The bottle 319 would then be rotated vertically into a vertical orientation FIG. 4 in order to open the ball valve device 300 and allow gravity to empty the carrier particles in it into the pressurized hopper 210. Once the bottle 319 is empty, the bottle would be rotated back towards and into the horizontal position, sealing the hopper. The through-bore is then aligned with a pressure release port 332 for releasing pressure from within the attached bottle or container 319 before it is removed or detached. In this way the hopper pressure is maintained and an airtight, leak proof seal is maintained at all times.

More specifically, the ball valve device 300 includes (a) a valve housing 310 for mounting over a refill opening 212 into the pressurized hopper 210, with the valve housing having a wall 311 defining a chamber 312, a first port 314 and a second port 316 into the chamber. The ball valve device 300 also includes (b) a valve ball 320 rotatable within the chamber 312 and including a through-bore 322 for material flow from a material container 319 through the second port 316 into the pressurized hopper 210, with the valve ball 320 having a horizontal, first hopper sealing position FIG. 3 for pressure sealing the second port 316 and the pressurized hopper 210 from the through-bore 322, and a vertical, second hopper opening position FIG. 4 for opening the second port 316 and the pressurized hopper 210 to the through-bore 322. The ball valve device 300 further includes (c) a pressure release assembly 330 including (i) a pressure release port 332, 322' formed through the wall 311 of the valve housing 310 and spaced from the first port 314 and the second port 316; and (ii) a pressure release and particle catch device 334 connected externally to the pressure release port 332, 332' for receiving pressure and remnant carrier particles from the refill container 319, thereby allowing safe release of pressure within the through-bore and within the refill container after refilling the pressurized hopper.

Figure 3:
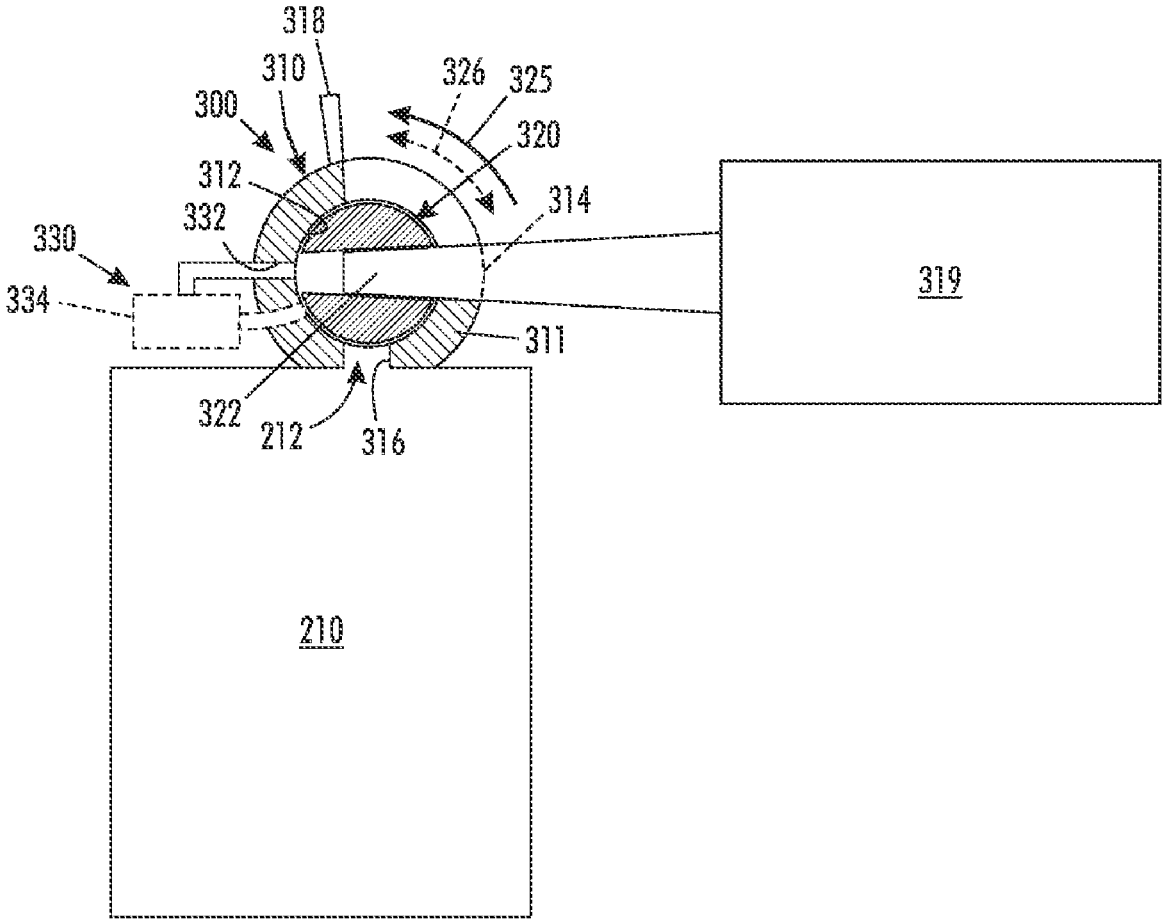
FIG. 3 is an enlarged schematic of the ball valve device of the present disclosure in the hopper sealing position.
Figure 4:
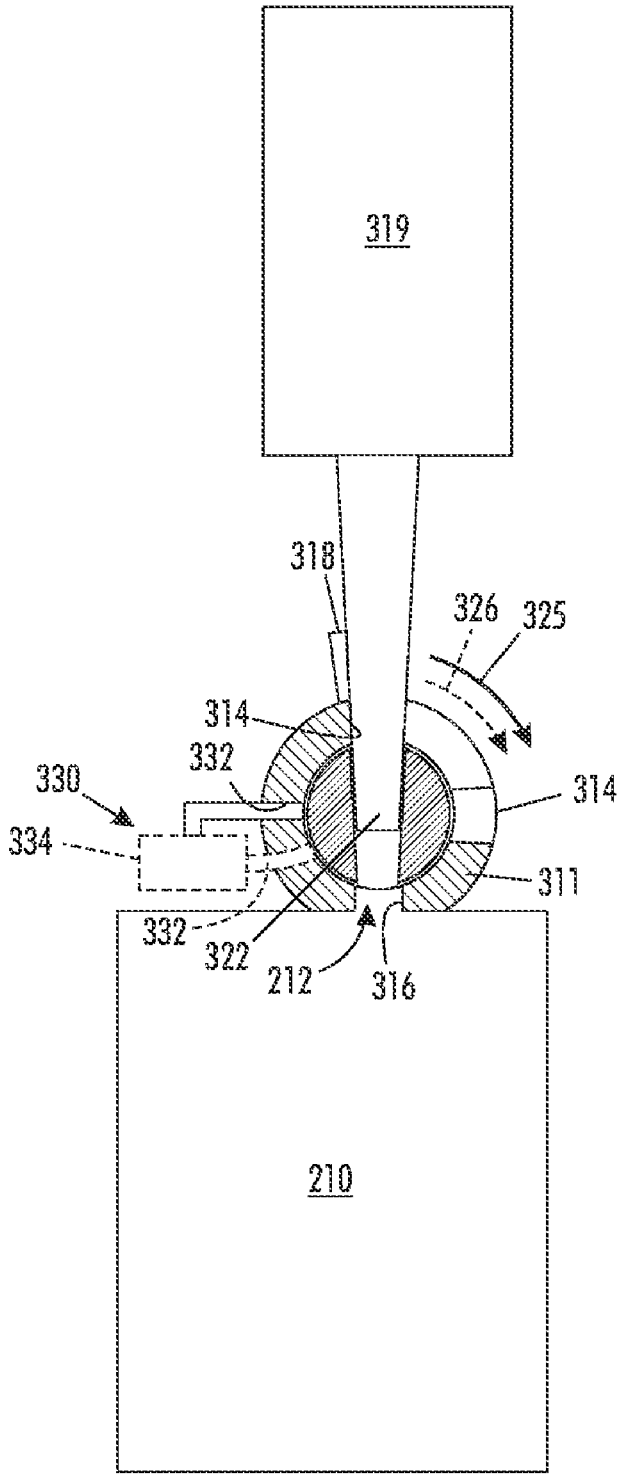
FIG. 4 is an enlarged schematic of the ball valve device of the present disclosure in the hopper opened position.

The pressure release port 332, 332' is alignable with the through-bore 322 when the valve ball 320 is not in the vertical, second hopper opening position of FIG. 4. The pressure release port 332, 332' is alignable with the through-bore 322 when the valve ball is in the horizontal, first hopper sealing position FIG. 3 as shown. The valve ball 320 and the through-bore 322 is rotatable as shown by arrow 325 within the chamber through an arc aperture 326 in the wall from a horizontal orientation FIG. 3 of the through-bore into a vertical orientation FIG. 4 of the through-bore. The valve ball 320 is in the hopper sealing position when its through-bore 322 is not in the vertical orientation of FIG. 4 or is in the horizontal orientation FIG. 3. The valve ball 320 is in the hopper opening position when its through-bore 322 is in the vertical orientation FIG. 4. The ball valve device 300 includes a limit stop plate 318 for stopping and aligning the valve ball 320 and its through-bore 322 in the vertical orientation FIG. 4. Alternatively any cylindrical structure can be used as a "ball valve" 320. This will allow for a more compact design. A cylindrical structure enables a larger area slot opening in 212.

A residual pressure free method of filling a pressurized hopper 210 in accordance with the present disclosure includes (a) attaching a refill container 319, that is full, to a first end of a through-bore 322 of a valve ball 320 that is in a horizontal, hopper sealing position FIG. 3 within a chamber 312 of a valve housing 310 mounted over a refill opening 212 into the pressurized hopper, with the valve housing 310 having a wall 311 defining the chamber, a first port 314, a second port 316, and an arc aperture 326 into the chamber; (b) rotating 325 the valve ball 320 within the chamber in a first direction FIG. 3 through the arc aperture, with the refill container attached, from the horizontal, hopper sealing position into a vertical, hopper opening position FIG. 4 for material to flow from the refill container through a second end of the through-bore 322, and through the second port 316, into the pressurized hopper 210; (c) emptying the contents of the refill container 319 into the pressurized hopper and thereby pressurizing the through-bore 322 and the refill container 319, now emptied; (d) re-rotating 325 the valve ball within the chamber in a second and opposite direction FIG. 4, with the refill container, now emptied, attached, from the vertical, hopper opening position into a hopper sealing position; (e) aligning the second end of the through-bore to a pressure release port 332, 322' formed through the wall 311 of the valve housing and spaced from the first port and the second port; (f) waiting a few seconds for pressure within the through-bore and within the refill container, now emptied, to dissipate through the pressure release port 332, 322'; and (g) safely unloading the refill container, now emptied and depressurized, from the first end of the through-bore of the valve ball while in a hopper sealing position.

The step of aligning the second end comprises aligning the second end of the through-bore with the pressure release port 322 when the valve ball is re-rotated back into the horizontal, hopper sealing position FIG. 3. The step of aligning the second end comprises aligning the second end of the through-bore with the pressure release port 332' when the valve ball is re-rotated back into a hopper sealing position between the vertical, hopper opening position of FIG. 4 and the horizontal, hopper sealing position of FIG. 3.

As can be seen, there has been provided a ball valve device for filling pressurized hoppers includes (a) a valve housing having a wall defining a chamber, a first port and a second port; (b) a valve ball rotatable within the chamber and including a through-bore for material flow from a refill container through the second port into the hopper, the valve ball having a horizontal, first hopper sealing position for pressure sealing the second port, and a vertical, second hopper opening position for opening the second port to the through-bore; and (c) a pressure release assembly including (i) a pressure release port formed through the valve housing wall and spaced from the first port and the second port; and (ii) a pressure release and particle catch assembly connected externally to the pressure release port for receiving pressure and remnant carrier particles from the refill container, thereby allowing safe release of pressure from the through-bore and from the refill container following refilling of the pressurized hopper.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A ball valve device for filling pressurized hoppers comprising:

(a) a valve housing for mounting over a refill opening into a pressurized hopper, said valve housing having a wall defining a chamber, a first port and a second port into said chamber;

(b) a valve ball rotatable within said chamber and including a through-bore for material flow from a material container through said second port into the pressurized hopper, said valve ball having a horizontal, first hopper sealing position for pressure sealing said second port and the pressurized hopper from said through-bore, and a vertical, second hopper opening position for opening said second port and the pressurized hopper to said through-bore; and (c) a pressure release assembly including (i) a pressure release port formed through said wall of said valve housing and spaced from said first port and said second port; and (ii) a pressure release assembly connected externally to said pressure release port for receiving pressure and remnant carrier particles from said refill container, thereby allowing safe release of pressure within said through-bore and within said refill container after refilling the pressurized hopper.

2. The ball valve device of claim 1, wherein said pressure release port is alignable with said through-bore when said valve ball is not in said vertical, second hopper opening position.

3. The ball valve device of claim 1, wherein said pressure release port is alignable with said through-bore when said valve ball is in said horizontal, first hopper sealing position.

4. The ball valve device of claim 1, wherein said valve ball and said through-bore are rotatable within said chamber through and arc aperture in said wall from a horizontal orientation of said through-bore into a vertical orientation of said through-bore.

5. The ball valve device of claim 4, wherein said valve ball is in said hopper sealing position when said through-bore is in said horizontal orientation.

6. The ball valve device of claim 4, wherein said valve ball is in said hopper opening position when said through-bore is in said vertical orientation.

7. The ball valve device of claim 6, including a limit stop plate for stopping and aligning said valve ball and said through-bore in said vertical orientation.

8. A residual pressure free method of filling a pressurized hopper, the method comprising:

(a) attaching a refill container, that is full, to a first end of a through-bore of a valve ball that is in a horizontal, hopper sealing position within a chamber of a valve housing mounted over a refill opening into the pressurized hopper, said valve housing having a wall defining said chamber, a first port, a second port, and an arc aperture into said chamber;

(b) rotating said valve ball within said chamber in a first direction through said arc aperture, with said refill container attached, from said horizontal, hopper sealing position into a vertical, hopper opening position for material to flow from said refill container through a second end of said through-bore, and through said second port, into the pressurized hopper;

(c) emptying the contents of the refill container into the pressurized hopper and thereby pressurizing the through-bore and the refill container, now emptied;

(d) re-rotating said valve ball within said chamber in a second and opposite direction, with said refill container, now emptied, attached, from said vertical, hopper opening position into a hopper sealing position;

(e) aligning said second end of said through-bore to a pressure release port formed through said wall of said valve housing and spaced from said first port and said second port;

(f) waiting a few seconds for pressure within said through-bore and within said refill container, now emptied, to dissipate through said pressure release port; and (g) safely unloading the refill container, now emptied and depressurized, from said first end of said through-bore of the valve ball while in a hopper sealing position.

9. The method of claim 8, wherein said step of aligning said second end comprises aligning said second end of said through-bore with said pressure release port when said valve ball is re-rotated back into said horizontal, hopper sealing position.

10. The method of claim 8, wherein said step of aligning said second end comprises aligning said second end of said through-bore with said pressure release port when said valve ball is re-rotated back into a hopper sealing position between said vertical, hopper opening position and said horizontal, hopper sealing position.

11. A development station including a pressurized hopper containing material used for developing images in an electrostatographic image reproduction machine, the development station comprising;

(a) developer housings each containing in-use two-component developer material including toner particles and charged magnetic carrier particles for developing images;

(b) a pressurized hopper containing charged magnetic carrier particles for adding to said developer housings; and (c) a ball valve device for filling said pressurized hopper without an unsafe blow-back condition, the ball valve device including:

(i) a valve housing for mounting over a refill opening into a pressurized hopper, said valve housing having a wall defining a chamber, a first port, a second, and an arc aperture into said chamber;

(ii) a valve ball within said chamber having an exterior surface, said valve ball being rotatable within said chamber and including a through-bore for material flow through said valve ball from a material container to and through said second port into the hopper, and said valve ball having a first hopper sealing position for pressure sealing said second port and the hopper from said through-bore, and a second hopper opening position for opening said second port and the hopper to said through-bore; and (iii) a pressure release assembly including a pressure release port formed through said wall of said valve housing from said chamber and spaced from said first port and said second port; and a pressure release assembly connected externally to said pressure release port for receiving pressure and remnant carrier particles, thereby allowing safe release of pressure within said through-bore and a refill container after refilling the pressurized hopper.

12. The development station of claim 11, wherein said pressure release port is alignable with said through-bore when said valve ball is not in said vertical, second hopper opening position.

13. The development station of claim 11, wherein said pressure release port is alignable with said through-bore when said valve ball is in said horizontal, first hopper sealing position.

14. The development station of claim 11, wherein said valve ball and said through-bore are rotatable within said chamber through and arc aperture in said wall from a horizontal orientation of said through-bore into a vertical orientation of said through-bore.

15. The development station of claim 14, wherein said valve ball is in said hopper sealing position when said through-bore is in said horizontal orientation.

16. An electrostatographic image reproduction machine comprising:

(a) a moveable imaging member including an imaging surface;

(b) imaging means for forming a latent image on said imaging surface;

(c) a toner development station including a pressurized hopper containing material used for developing said latent images; and (d) a ball valve device for filling said pressurized hopper without an unsafe blow-back condition, the ball valve device including:

(i) a valve housing for mounting over a refill opening into a pressurized hopper, said valve housing having a wall defining a chamber, a first port, a second, and an arc aperture into said chamber;

(ii) a valve ball within said chamber having an exterior surface, said valve ball being rotatable within said chamber and including a through-bore for material flow through said valve ball from a material container to and through said second port into the hopper, and said valve ball having a first hopper sealing position for pressure sealing said second port and the hopper from said through-bore, and a second hopper opening position for opening said second port and the hopper to said through-bore; and (iii) a pressure release assembly including a pressure release port formed through said wall of said valve housing from said chamber and spaced from said first port and said second port; and a pressure release assembly connected externally to said pressure release port for receiving pressure and remnant carrier particles, thereby allowing safe release of pressure within said through-bore and a refill container after refilling the pressurized hopper.

17. The electrostatographic image reproduction machine of claim 16, wherein said wherein said pressure release port is alignable with said through-bore when said valve ball is not in said vertical, second hopper opening position.

18. The electrostatographic image reproduction machine of claim 16, wherein said wherein said pressure release port is alignable with said through-bore when said valve ball is in said horizontal, first hopper sealing position.

19. The electrostatographic image reproduction machine of claim 16, wherein said wherein said valve ball and said through-bore are rotatable within said chamber through and arc aperture in said wall from a horizontal orientation of said through-bore into a vertical orientation of said through-bore.

20. The electrostatographic image reproduction machine of claim 19, wherein said wherein said valve ball is in said hopper sealing position when said through-bore is in said horizontal orientation.

* * * * *